US007311491B2

(12) United States Patent
Desbiolles

(10) Patent No.: US 7,311,491 B2
(45) Date of Patent: Dec. 25, 2007

(54) MOLECULAR DRAG, TURBOMOLECULAR, OR HYBRID PUMP WITH AN INTEGRATED VALVE

(75) Inventor: Jean-Pierre Desbiolles, Cruseilles (FR)

(73) Assignee: Alcatel, Paris (FR)

( * ) Notice: Subject to any disclaimer, the term of this patent is extended or adjusted under 35 U.S.C. 154(b) by 127 days.

(21) Appl. No.: 10/843,354

(22) Filed: May 12, 2004

(65) Prior Publication Data

US 2004/0228747 A1 Nov. 18, 2004

(30) Foreign Application Priority Data

May 13, 2003 (FR) ..... 03 05724

(51) Int. Cl.
*F01D 1/12* (2006.01)

(52) U.S. Cl. ..... 415/55.1; 415/90

(58) Field of Classification Search ..... 415/55.1, 415/55.2, 55.3, 55.4, 55.5, 90
See application file for complete search history.

(56) References Cited

U.S. PATENT DOCUMENTS 4,797,062 A * 1/1989 Deters et al. ..... 415/90
4,954,047 A * 9/1990 Okuyama et al. ..... 417/203
5,118,251 A * 6/1992 Saulgeot ..... 415/90
5,443,368 A 8/1995 Weeks et al.
5,893,702 A * 4/1999 Conrad et al. ..... 415/71
5,927,940 A * 7/1999 Lotz ..... 415/90
6,644,931 B2 * 11/2003 Puech ..... 417/205

FOREIGN PATENT DOCUMENTS

EP 0 585 911 A1 3/1994
WO WO 99/04325 1/1999

* cited by examiner

*Primary Examiner*—Hoang Nguyen
(74) *Attorney, Agent, or Firm*—Sughrue Mion, Pllc.

(57) ABSTRACT

A molecular drag, turbomolecular, or hybrid turbo/drag pump (5) of the invention has an outlet stage with a cylindrical peripheral wall (17) and a radial outlet orifice (23) passing through the cylindrical peripheral wall (17). An annular coaxial closure member (24) bears against the cylindrical peripheral wall (17) around the radial outlet orifice. The annular coaxial closure member (24) includes a through slot and optionally also a total closure shutter (26). The annular coaxial closure member (24) is caused to turn about the axis of the cylinder by a motor (8) in order to place its through slot or its total closure shutter (26) in register with the radial outlet orifice (23), or partially in register with the radial outlet orifice (23) in order to adjust the opening of the valve and regulate the gas flow pumped by the pump (5). A pump is thus provided that includes an integrated regulator and/or closure valve.

20 Claims, 8 Drawing Sheets

MOLECULAR DRAG, TURBOMOLECULAR, OR HYBRID PUMP WITH AN INTEGRATED VALVE

The present invention relates to gas pumping systems for establishing and regulating an appropriate vacuum in a process chamber such as a chamber for use in particular in the semiconductor industry.

Processes for fabricating semiconductors and microelectronic mechanical systems (MEMS) generally comprise successive steps that take place in a process chamber under an atmosphere at low pressure. Each step of the process is characterized by a gas pressure that needs to be regulated, e.g. for the purpose of sustaining a plasma or a bombardment of particles acting on a semiconductor substrate.

Most process steps take place in the presence of a suitable vacuum which is generated and maintained by a vacuum line that includes vacuum pumps connected to the process chamber.

The vacuum line of a process chamber generally comprises a secondary pump of the molecular drag, turbomolecular, or hybrid turbo/drag type connected to the output of the chamber with an interposed isolator valve, and which delivers into a connection pipe connected to the inlet of a primary pump whose own outlet delivers to atmospheric pressure. An isolator valve is generally provided at the outlet from the secondary pump.

In order to control the pressure in the process chamber it is necessary to provide means for modifying pumping conditions in the vacuum line, so as to be able to adapt said conditions to the successive steps of the processes. In traditional manner, pressure in a process chamber is controlled by operating a regulator valve placed directly at the outlet from the process chamber, upstream from the secondary pump. A problem which then arises lies in the risk of the regulator valve becoming dirtied by the pumped gas, and the associated risk of pollution returning from the regulator valve towards the process chamber during subsequent steps of processes.

One solution that has been envisaged in the past is to place the regulator valve in the connection pipe, i.e. between the delivery from the secondary pump and the suction of the primary pump. Document WO 99/04325 describes that solution in particular, consisting in providing a regulator valve connected to the inlet of the primary pump which is not speed controlled, while also providing for inert gas to be injected upstream from the regulator valve.

It is then found that regulation is degraded, very likely because of the lengthened response time that results from the presence of a larger volume of gas at high pressure between the delivery from the secondary pump and the regulator valve.

The problem posed by the present invention is simultaneously to reduce significantly the risk of the regulator valve becoming dirtied and the risk of pollution returning from the regulator valve to the process chamber, without significantly degrading the conditions under which pressure in the process chamber is regulated. In particular, it is necessary to guarantee rapid reaction of the pressure regulation means during transitions between successive steps of processes.

Simultaneously, the invention makes it possible to reduce the volume occupied due to the presence of the regulator valve itself.

The idea on which the invention is based is to integrate the regulator valve within the structure of the secondary pump, by providing a special valve structure having a closure member which acts directly on a radial outlet orifice through the cylindrical peripheral wall of the pump.

In practice, a secondary pump of the molecular drag, turbomolecular, or hybrid turbo/drag type is provided at the outlet stage, and the closure member acts directly on the radial outlet orifice provided through the cylindrical peripheral wall of said outlet stage.

As a result, the regulator valve is placed as close as possible to the secondary pump, which is itself placed as closed as possible to the process chamber, thereby reducing the time required to react to upstream disturbances in the atmosphere within the process chamber.

The invention also takes advantage of the natural heating of the secondary pump, which heats the valve integrated therewith, thus reducing the risk of pumped gas being deposited or condensing on the parts of the regulator valve.

It may also be desirable to confer sealing of sufficient quality on the structure of the regulator valve to enable it to act also as a downstream isolator valve. This eliminates the need for an additional downstream isolator valve.

To achieve these objects, and others, the invention provides a molecular drag, turbomolecular, or turbo/drag hybrid pump having an outlet stage with a cylindrical peripheral wall and a radial outlet orifice passing through the cylindrical peripheral wall; the pump of the invention further comprises an integrated regulator and/or isolator valve having an annular coaxial closure member with a through slot that co-operates directly with the radial outlet orifice of the outlet stage in order to perform closure and/or regulation.

In a first embodiment, the annular coaxial closure member is placed inside the cylindrical peripheral wall in an annular delivery space, the member bearing against the inside face of the radial outlet orifice.

In another embodiment, the annular coaxial closure member bears against the outside face of the radial outlet orifice, and is disposed around the cylindrical peripheral wall of the outlet stage.

Advantageously, the annular coaxial closure member is driven to turn about the axis of the cylinder by a motor to position the through slot in adjustable manner relative to the radial outlet orifice. Turning the coaxial annular closure member moves the through slot relative to the radial outlet orifice, thus controlling the flow of gas passing through the regulator and/or isolator valve.

In practice, the annular coaxial closure member may include a rack meshing with a gearwheel rotated by the motor.

Advantageously, the motor is housed in a housing fitted radially against the cylindrical peripheral wall of the pump, with sealing gaskets interposed between them.

Preferably, the valve provides-leaktight total closure in the closed position.

For this purpose, the annular coaxial closure member may include sealing means mounted to provide leaktight closure in the closed position.

In a practical embodiment, the annular coaxial closure member includes a total closure shutter mounted to move radially on the annular coaxial closure member and urged to move radially by displacement means which press it against the periphery of the radial outlet orifice when it is in register with said radial outlet orifice, and which move it away from the cylindrical peripheral wall in other angular positions thereof.

To further reduce the risk of the regulator valve becoming dirtied, provision may advantageously be made to inject nitrogen into an annular delivery space of the outlet stage.

Preferably, nitrogen injection can be performed inside the housing containing the motor driving the coaxial annular closure member of the regulator valve, thereby also protecting the motor itself against any risk of being polluted by the pumped gas.

Advantageously, the through slot in the annular coaxial closure member may be given a shape that is adapted to obtain a conductance curve that is appropriate for regulation that is stable and effective. The shape of the through slot defines how conductance varies as a function of the angle to which the annular coaxial closure member is turned.

In another aspect, the invention also provides a system for pumping gas from a process chamber, the system comprising at least one secondary pump of the molecular drag, turbomolecular, or turbo/drag hybrid type with an outlet stage, and including at least one regulator and/or isolator valve controlling the flow of pumped gas; according to the invention, the regulator and/or isolator valve is integrated in the outlet stage as defined above.

The regulator and/or isolator valve may advantageously be controlled by a motor and control means for regulating pressure upstream from the secondary pump.

Other objects, characteristics, and advantages of the present invention appear from the following description of particular embodiments, made with reference to the accompanying figures, in which.

Figure 1:
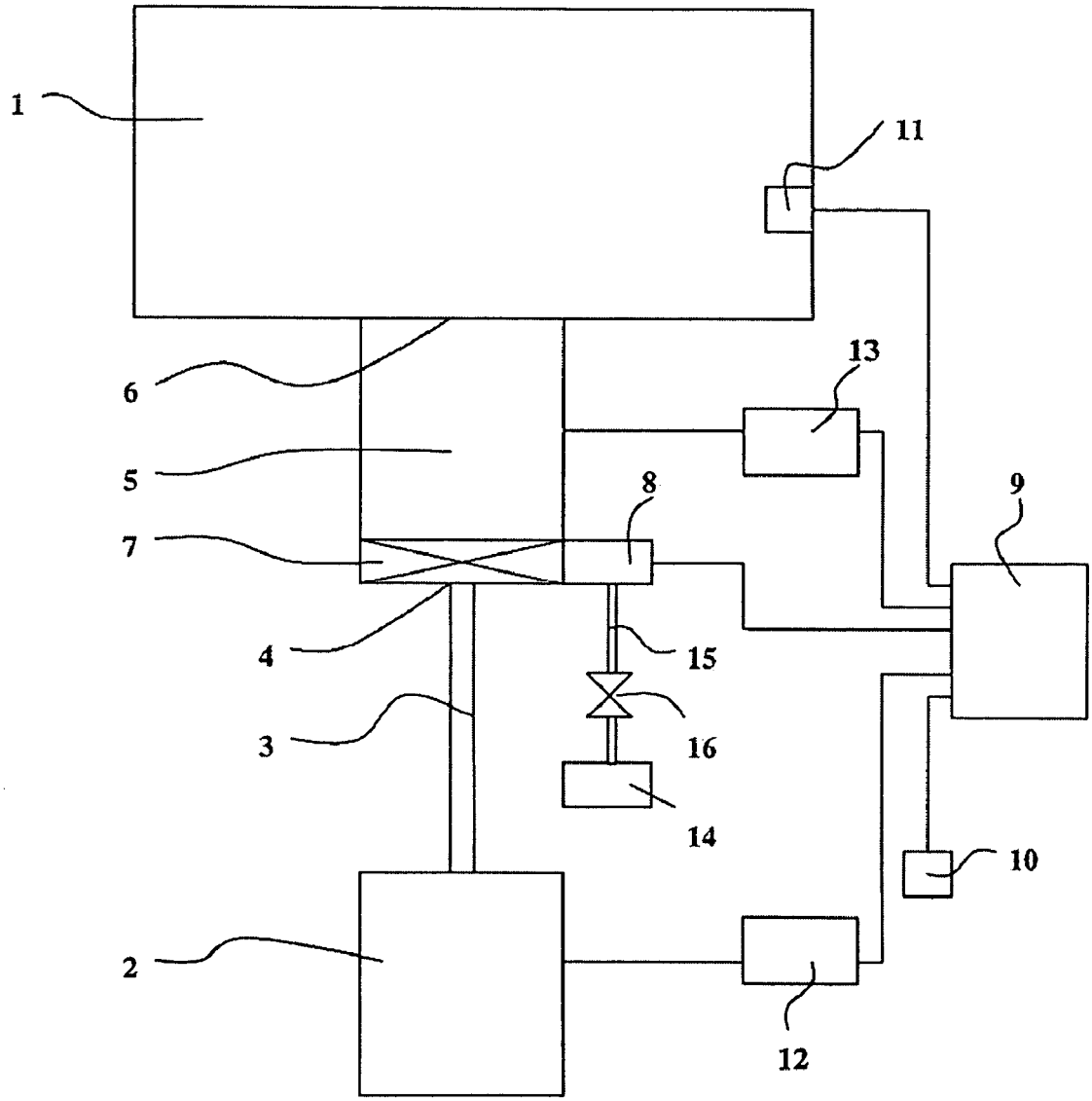
FIG. 1 is a block diagram of a system for pumping gas from a process chamber in an embodiment of the present invention.

In the embodiment shown in FIG. 1, in a vacuum line for controlling the vacuum in a process chamber 1, there are provided a primary pump 2 which delivers to atmospheric pressure and whose suction is connected via a connection pipe 3 to the delivery 4 from a secondary pump 5 whose suction 6 is connected to the process chamber 1.

Within the secondary pump 5 itself, the delivery 4 from the secondary pump 5 includes a regulator valve 7 associated with means 8 for controlling the regulator valve 7.

As explained below, the regulator valve 7 may comprise a closure member that is mechanically movable by a motor constituting the means 8 for controlling the regulator valve 7. The motor 8 may be controlled by control means 9 such as a microprocessor or a microcontroller. In order to regulate the pressure in the process chamber 1, the control means 9 can receive a reference signal produced by a reference generator 10, and measurement signals produced by a pressure sensor 11 in the process chamber 1, for example.

The pressure in the process chamber 1 can be controlled by opening the regulator valve 7 to a greater or lesser extent under actuation from the motor 8. In addition, provision can be made, where necessary, for the control means 9 to control a power supply 12 that governs the speed of the primary pump 2, and/or a power supply 13 that governs the speed of the secondary pump 5.

A source 14 of inert gas, e.g. of nitrogen, can advantageously be connected via a pipe 15 and a control valve 16 to a housing containing the motor 8 for the purpose of injecting inert gas which propagates towards the inside of the outlet stage of the secondary pump 5 through the regulator valve 7.

Reference is now given to FIGS. 2 to 11, which show an advantageous embodiment of a secondary pump 5 of the present invention.

The invention applies to secondary pumps that can be of the molecular drag type, of the turbomolecular type, or of the hybrid turbo/drag type.

In a molecular drag pump, and in particular in a Holweck type molecular drag pump, the stator comprises a cylindrical peripheral wall around an inner skirt of the stator from which it is separated by an annular delivery space. A radial outlet orifice passes through the peripheral cylindrical wall, and thus puts the outside atmosphere into communication with the annular delivery space. A rotor having helical ribs is engaged coaxially in the inside space defined by the inner skirt of the stator, and it is rotated about the axis of the pump.

In a secondary pump of the turbomolecular type, the rotor and the stator have finned stages which are interleaved between one another.

In a hybrid type secondary pump, there are to be found, starting from the suction end of the pump, firstly compression stages of the molecular drag type with fins, followed by at least one outlet stage of the Holweck type.

In the embodiment of FIGS. 2 to 11, there is shown only the outlet stage of such a secondary pump 5 of the molecular drag or hybrid type, which stage may be associated with other stages, such as turbo stages.

The outlet stage of such a molecular drag or hybrid pump 5 comprises a cylindrical peripheral wall 17, a coaxial inner skirt 18 of the stator with helical inside ribs 19, and a Holweck rotor (not shown in the figures) which is engaged coaxially in the inside space 20 defined by the inner skirt 18 of the stator and driven in rotation about the axis of the pump by a main motor (not shown).

Figure 2:
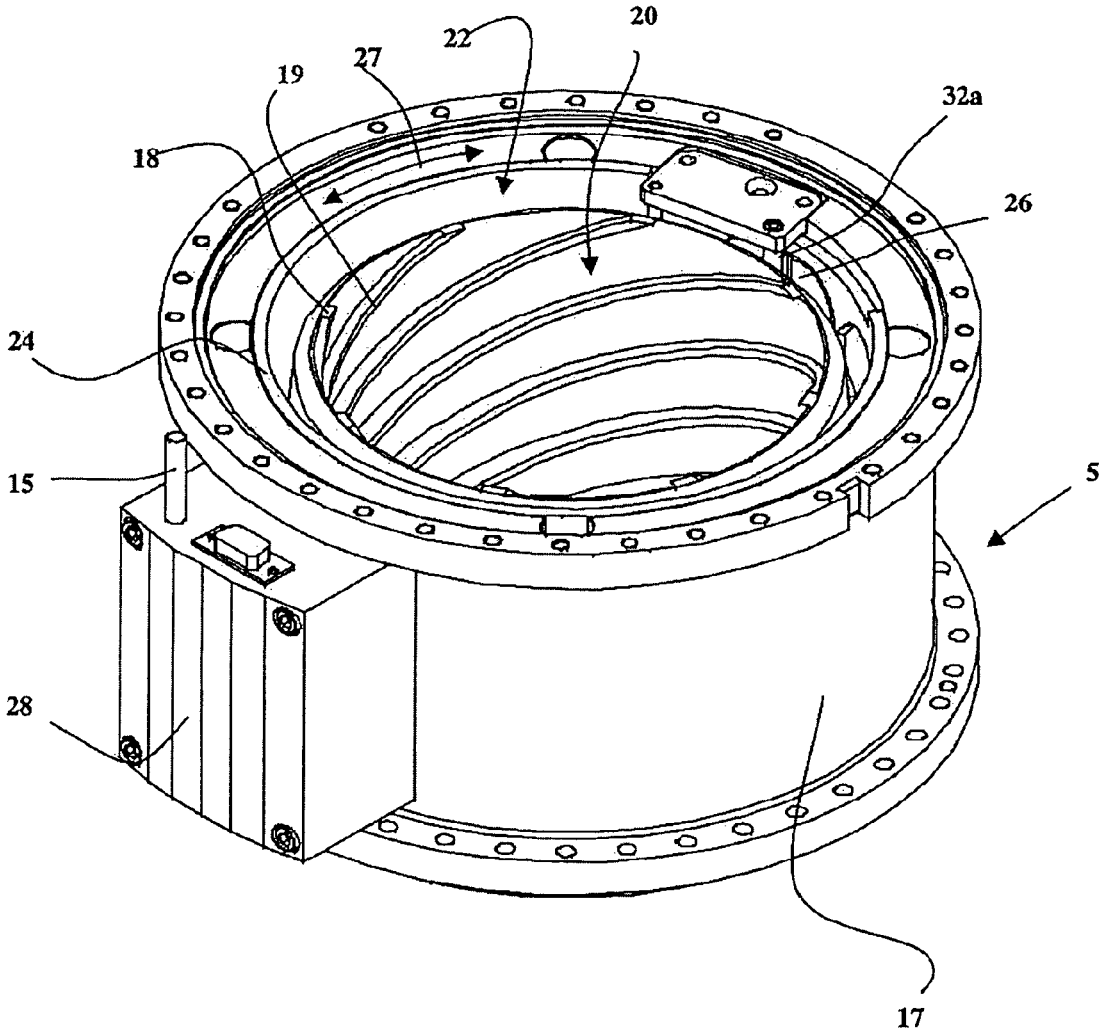
FIG. 2 is a perspective view of a Holweck stage for a molecular drag or hybrid pump in an embodiment of the invention.

In FIG. 2, it should be observed that the secondary pump 5 is seen from its downstream face, with the downstream closure wall being removed therefrom so as to reveal the internal members of the pump. In operation, the downstream face of the pump is closed by a leaktight wall of disk shape which is secured to the cylindrical peripheral wall 17 and defines a downstream chamber 21 (see in particular FIG. 6). The pumped gas is sent by the Holweck rotor towards the downstream chamber 21 which itself communicates with an annular delivery space 22 situated between the cylindrical peripheral wall 17 and the inner skirt 18 of the stator.

The cylindrical peripheral wall 17 has a radial outlet orifice 23 through which the delivered gas escapes from the annular delivery space 22.

In the invention, a regulator valve of special structure is provided having a closure element that is directly adjacent to the radial outlet orifice 23 through the cylindrical peripheral wall 17 of the Holweck stage of the secondary pump 5.

For this purpose, the regulator valve comprises an annular coaxial closure member 24 of cylindrical shape pressing in leaktight manner against one of the faces of the radial outlet orifice 23, having a through slot 25 (see FIG. 5) in a portion of its periphery, and driven to turn about the axis so as to enable said through slot 25 to be adjustably positioned in an angular orientation that is more or less in alignment with or offset from the radial outlet orifice 23 so as to adjust the conductance of the regulator valve.

Figure 5:
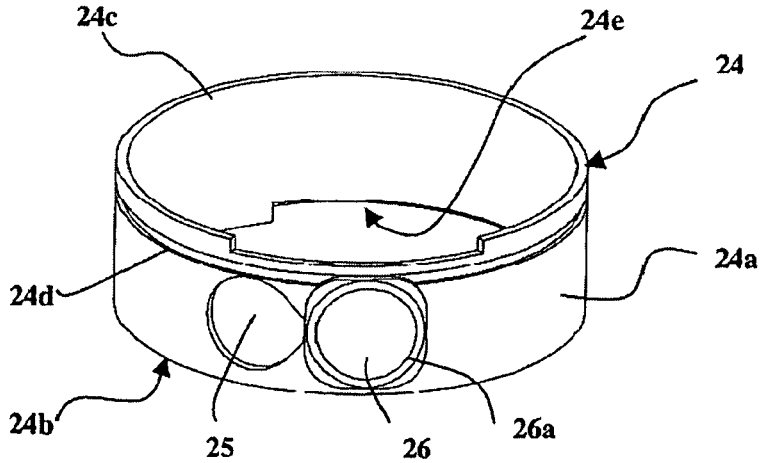
FIG. 5 is a perspective view of an annular coaxial closure member of the FIG. 2 pump.

A particular embodiment of such an annular coaxial closure member 24 is shown on its own and in perspective in FIG. 5. In this figure, it can be seen that the annular coaxial closure member 24 is cylindrical in shape, being constituted by a continuous cylindrical wall 24*a* that is defined by an upstream circular edge 24*b* and a downstream circular edge 24*c*. A guide groove 24*d* is provided in the outside face of the wall 24*a* to co-operate with guide means that determine the axial position of the annular cylindrical closure member 24 in the body of the pump.

The upstream circular edge 24*b* includes a toothed portion 24*e* for co-operating with a driving gearwheel driven by a motor for turning the annular coaxial closure member 24 about the axis in the body of the pump.

In FIG. 5, there can also be seen the through slot 25 which, when the angular position of the annular coaxial closure member 24 places it in register with the radial outlet orifice 23 (FIG. 6) of the pump, serves to define the position in which the valve is fully open, and which closes the regulator valve to a greater or lesser extent on being offset away from the radial outlet orifice 23. The through slot 25 is given a shape that is adapted to obtain an appropriate conductance curve for performing stable and effective regulation by controlling the angular position of the annular coaxial closure member 24 about the axis of the pump.

In FIG. 5, there can also be seen a total closure shutter 26 that is radially movable on the annular coaxial shutter 24 so as to be urged radially by radial displacement means that are described below. The total closure shutter 26 includes a front gasket 26*a* for providing total sealing in the closed position.

In the embodiment shown in the figures, the annular coaxial closure member 24 is placed inside the annular delivery space 22 and is turnable about the axis of the pump as represented by double-headed arrows 27 in FIG. 2.

Figure 6:
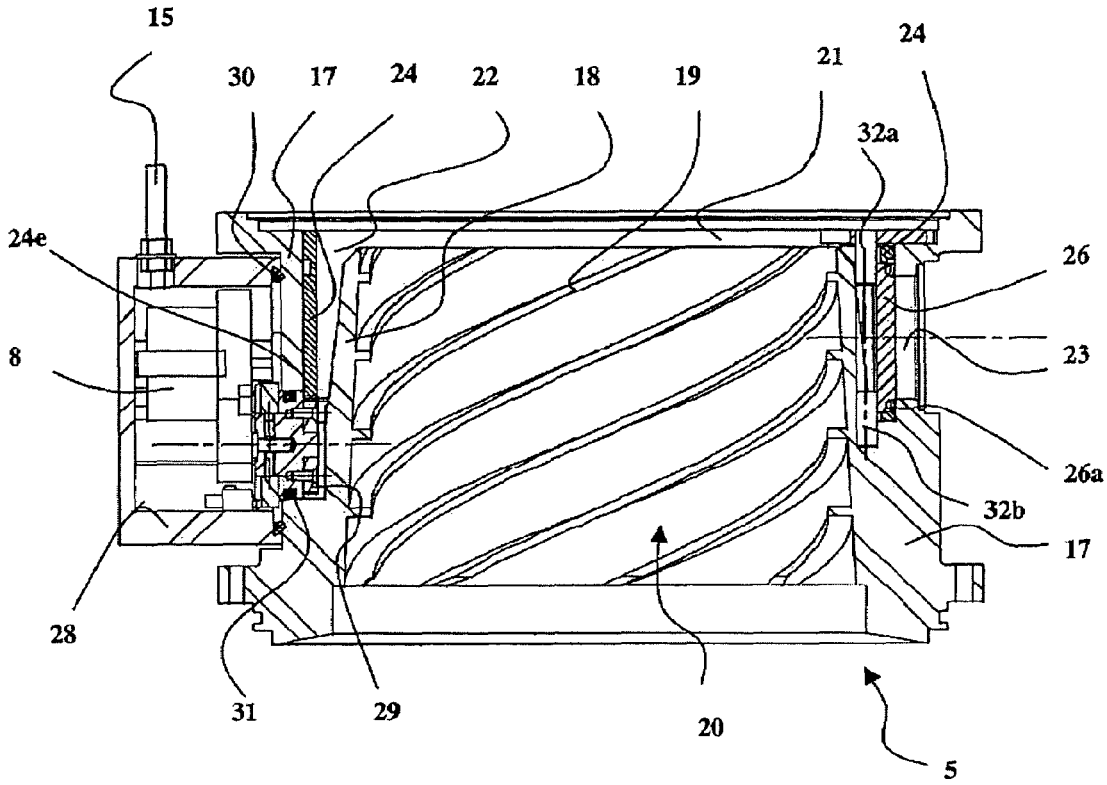
FIG. 6 is a diametral section through the Holweck stage of FIG. 2 in its totally closed state.

To perform this turning movement 27, the annular coaxial closure member 24 is driven by the motor 8 which is placed in a housing 28 fitted radially onto the peripheral cylindrical wall 17, as can be seen more clearly in FIG. 6. The motor 8 drives a gearwheel 29 which meshes with the toothed portion 24*e* of the upstream circular edge 24*b* of the annular coaxial closure member 24.

The housing 28 is fitted radially onto the cylindrical peripheral wall 17 of the pump body with a front annular sealing gasket 30 being interposed between them. A second annular sealing gasket 31 that acts radially is also provided in the cylindrical peripheral wall 17 inside the orifice through which the shaft carrying the gearwheel 29 passes.

In FIG. 6, there can also be seen the delivery end of the pipe 15 for injecting inert gas into the housing 28 containing the motor 8. Such injection of inert gas causes a flow of inert gas to pass through the motor 8 towards the secondary pump 5, preventing pumped gas from flowing from the secondary pump 5 towards the motor 8 in order to reduce the risks of the motor 8 being polluted, while simultaneously diluting the gas in the Holweck stage, thereby further reducing any risk of deposition. One-way flow of inert gas is ensured by providing at least one calibrated axial hole that passes through the gearwheel 29.

Because of its position inside the annular delivery space 22, the annular coaxial closure member 24 takes advantage of the outlet heating of the Holweck stage, thereby reducing the risk of pumped gas being deposited on the elements of the regulator valve. However, and above all, this position of the annular coaxial closure member 24 minimizes the volume of high pressure gas upstream from the regulator valve 7, thereby improving the ability of the regulation to be reactive.

In FIG. 6, the regulator valve is shown in the fully-closed position. In this case, the annular coaxial closure member 24 is placed in an angular position such that the total closure shutter 26 is exactly in register with the radial outlet orifice 23. The total closure shutter 26 is pressed against the inside face of the cylindrical peripheral wall 27 around the entire periphery of the radial outlet orifice 23, and its annular sealing gasket 26*a* is pressed against the periphery of the radial outlet orifice 23 in order to provide good sealing.

Figure 7:
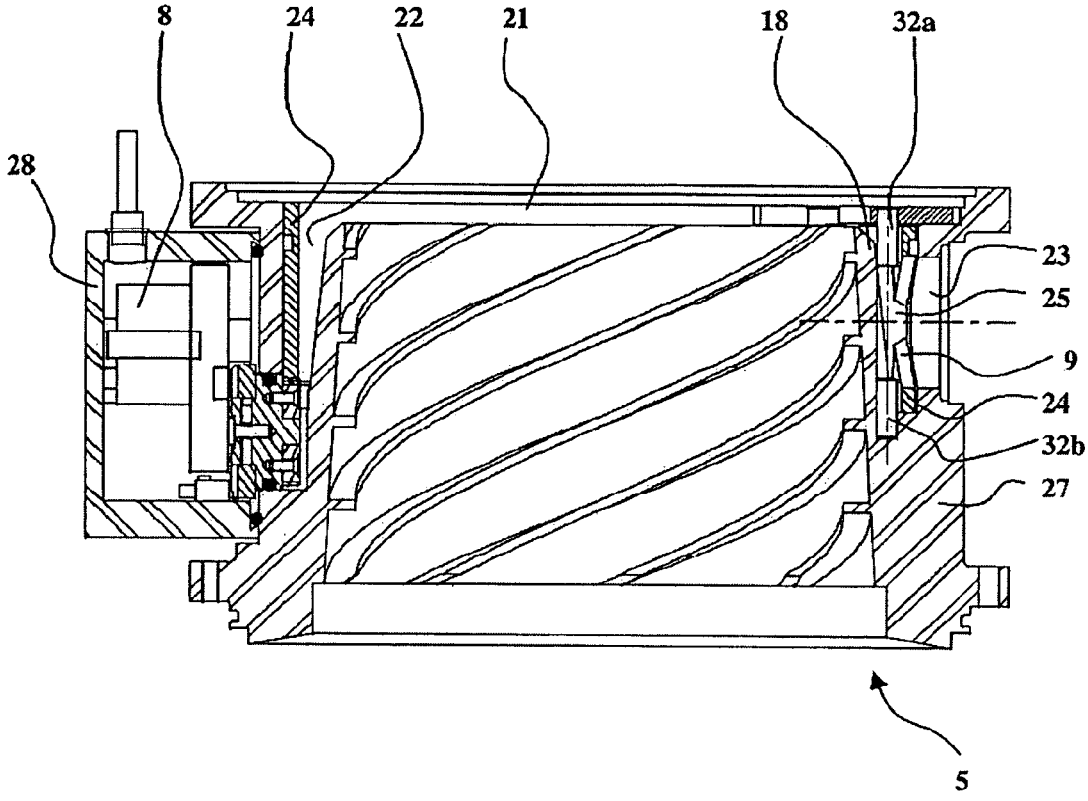
FIG. 7 is a diametral section of the Holweck stage of FIG. 2 in its fully open state.

In FIG. 7 the secondary pump 5 is shown in a state in which the regulator valve is in its fully-open position. This figure shows the same elements as FIG. 6, and they are identified by the same numerical references.

In this fully-open position, the annular coaxial closure member 24 has been turned by action of the motor 8 so as to bring the through slot 25 into register with the radial outlet orifice 23, so as to allow the greatest possible amount of gas delivered by the pump to pass through. The total closure shutter 26 is then retracted sideways, and is shown in the figure.

Figure 8:
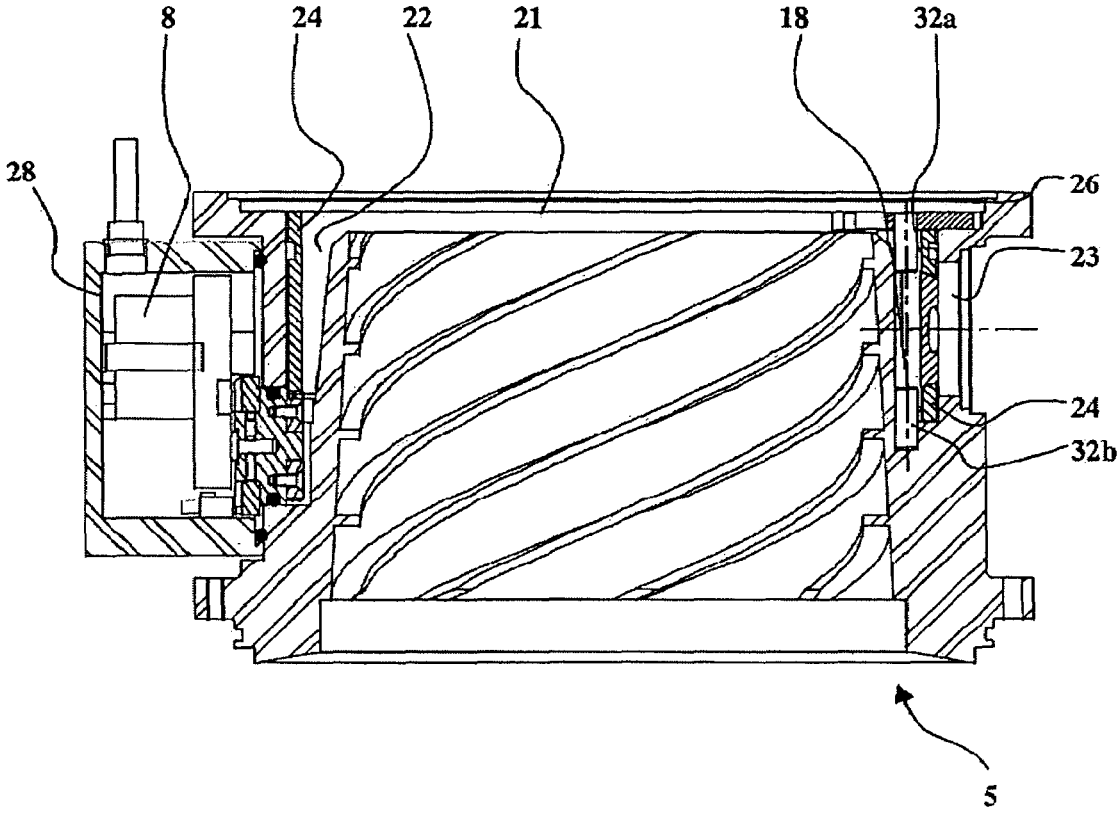
FIG. 8 is a diametral section of the Holweck stage of FIG. 2, in a partially-open state.
Figure 9:
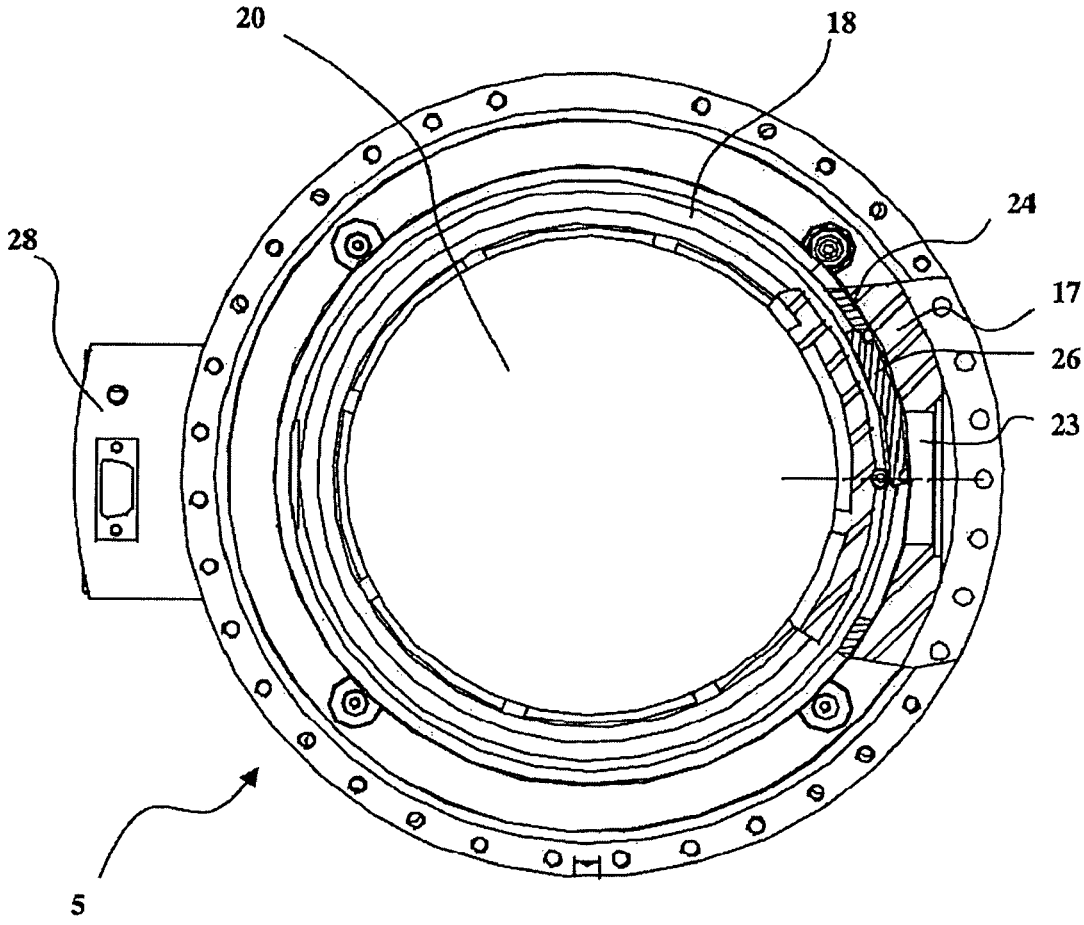
FIG. 9 is a plan view of the Holweck stage of FIG. 2 in the partially-open state shown in FIG. 8.

In FIG. 8, there can be seen a diametral section through the secondary pump 5 of FIG. 5 in a partially-open position, which position is also shown in plan view in FIG. 9. In this case, the annular coaxial closure member 24 has been turned angularly by the motor so as to bring the through slot 25 partially into register with the radial outlet orifice 23, which radial outlet orifice 23 is partially obstructed by the total closure shutter 26. The valve is shown in its half-open position.

In order to enable the annular coaxial closure member 24 to turn freely, the total closure shutter 26 is movable radially so as to be moved away from the cylindrical peripheral wall 17 in all angular positions of the annular coaxial closure member 24 other than the total closure position as shown in FIG. 6.

Figure 10:
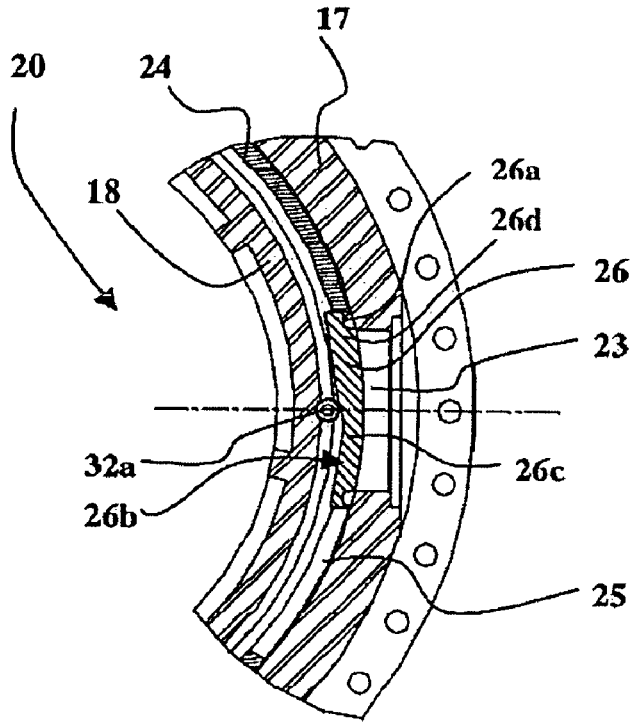
FIG. 10 is a fragmentary plan view showing a detail of the total closure shutter in the fully closed position.
Figure 11:
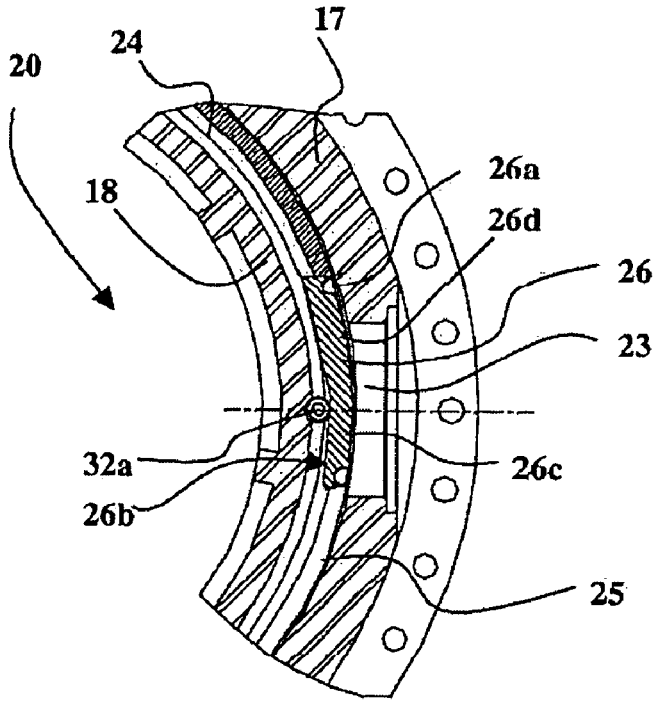
FIG. 11 is a detail plan view showing the total closure shutter in its set-back position for opening.

For this purpose, and as can be seen in greater detail in FIGS. 10 and 11, the total closure shutter 26 has an inside face 26*b* with a ramp, between a thinner portion 26*c* and a thicker portion 26*d*. The inside face 26*b* bears radially against two rollers 32*a* and 32*b* that can be seen clearly in the figures that are in diametral section. In fully- or partially-open positions, as shown in FIG. 11, the rollers such as the roller 32*a* bear against the thinner portion 26*c* of the total closure shutter 26, thus enabling the total closure shutter 26 to be offset radially towards the axis of the pump, away from the cylindrical peripheral wall 17. In contrast, in the vicinity of the total closure position, as shown in FIG. 10, the rollers such as the roller 32*a* bear against the thicker portion 26*d* of the total closure shutter 26, urging the total closure shutter 26 outwards so as to press it against the cylindrical peripheral wall 17 around the periphery of the radial outlet orifice 23, the gasket 26*a* then providing good sealing.

Figure 3:
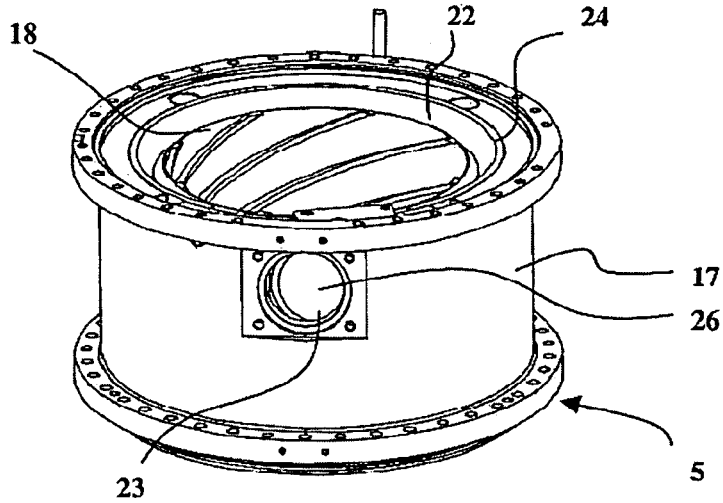
FIGS. 3 and 4 are two other views on a smaller scale of the Holweck stage shown in FIG. 2, respectively in a state of being almost completely closed, and in a state of being partially open.

FIG. 3 is a perspective view of the secondary pump 5 in the position of FIG. 11: the total closure shutter 26 is slightly off-center relative to the radial outlet orifice 23.

Figure 4:
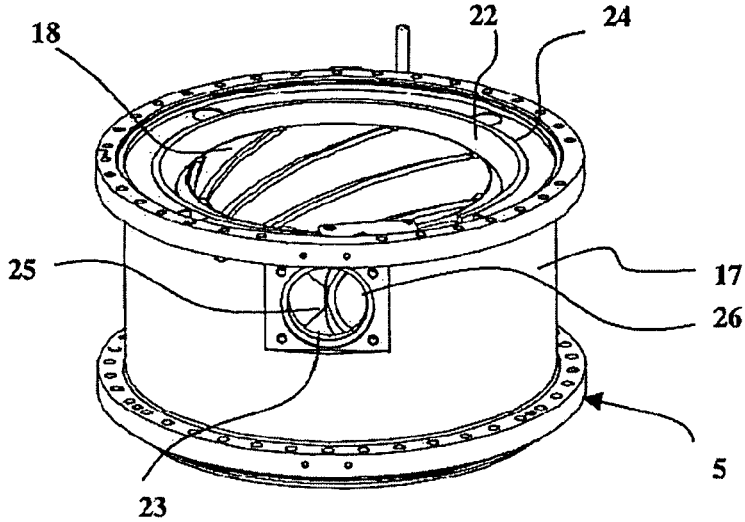

FIG. 4 shows the secondary pump 5 in the half-open position shown in FIGS. 8 and 9. The total closure shutter 26 is offset through half the width of the radial outlet orifice 23, and there can also be seen half of the through slot 25.

In the embodiment shown in the figures, the regulator valve, provided with a total closure shutter 26, can also act as an isolator valve.

It will be understood that in the invention provision can be made for a simplified embodiment in which the annular coaxial closure member 24 has only the through slot 25 and does not have a total closure shutter 26. Under such circumstances, the valve provides a regulator valve function only, and the fully-closed position of the valve is not leaktight.

Similarly, in the embodiment shown in the figures, the annular coaxial closure member 24 is placed inside the pump and comes to bear against the inside face of the cylindrical peripheral wall 17 about the radial outlet orifice 23.

Alternatively, it will be possible to place the annular coaxial closure member 24 outside the cylindrical peripheral wall 17, bearing against the edges of the radial outlet orifice 23.

The present invention is not limited to the embodiments described explicitly, but includes the various generalizations and variants that are within the competence of the person skilled in the art.

What is claimed is:

1. A molecular drag, turbomolecular, or turbo/drag hybrid pump (5) having an outlet stage with a cylindrical peripheral wall (17) and a radial outlet orifice (23) passing through the cylindrical peripheral wall (17), the pump being characterized in that it further comprises an integrated adjustable regulator and/or isolator valve having an annular coaxial closure member (24) with a through slot (25) that co-operates directly with the radial outlet orifice (23) of the outlet stage in order to perform closure and/or adjustable regulation.

2. A molecular drag, turbomolecular, or turbo/drag hybrid pump according to claim 1, in which the annular coaxial closure member (24) is placed inside the cylindrical peripheral wall (17) in an annular delivery space (22), the member bearing against the inside face of the radial outlet orifice (23).

3. A molecular drag, turbomolecular, or turbo/drag hybrid pump according to claim 1, in which the annular coaxial closure member (24) bears against the outside face of the radial outlet orifice (23), and is disposed around the cylindrical peripheral wall (17) of the outlet stage.

4. A molecular drag, turbomolecular, or turbo/drag hybrid pump according to claim 1, in which the annular coaxial closure member (24) is driven to turn about the axis of the cylinder by a motor (8) to position the through slot (25) in adjustable manner relative to the radial outlet orifice (23).

5. A molecular drag, turbomolecular, or turbo/drag hybrid pump according to claim 4, in which the annular coaxial closure member (24) includes a rack (24*e*) meshing with a gearwheel (29) rotated by the motor (8).

6. A molecular drag, turbomolecular, or turbo/drag hybrid pump according to claim 4, in which the motor (8) is housed in a housing (28) fitted radially against the cylindrical peripheral wall (17) of the pump, with sealing gaskets (30, 31) interposed between them.

7. A molecular drag, turbomolecular, or turbo/drag hybrid pump according to claim 1, in which the valve provides leaktight total closure in the closed position.

8. A molecular drag, turbomolecular, or turbo/drag hybrid pump according to claim 7, in which the annular coaxial closure member (24) includes sealing means (26, 26*a*) mounted to provide leaktight closure in the closed position.

9. A molecular drag, turbomolecular, or turbo/drag hybrid pump according to claim 8, in which the annular coaxial closure member (24) includes a total closure shutter (26) mounted to move radially on the annular coaxial closure member (24) and urged to move radially by displacement means (26*b*, 32*a*, 32*b*) which press it against the periphery of the radial outlet orifice (23) when it is in register with said radial outlet orifice (23), and which move it away from the cylindrical peripheral wall (17) in other angular positions thereof.

10. A molecular drag, turbomolecular, or turbo/drag hybrid pump according to claim 1, in which provision is further made to inject nitrogen into an annular delivery space (22) of the outlet stage.

11. A molecular drag, turbomolecular, or turbo/drag hybrid pump according to claim 10, in which nitrogen is injected into a housing (28) containing a motor (8) for driving the annular coaxial closure member (24).

12. A system comprising a process chamber and a pumping mechanism for pumping gas from the process chamber (1), the pumping mechanism comprising the molecular drag, turbomolecular, or turbo/drag hybrid pump of claim 1, which is a secondary pump of the system, and wherein the regulator and/or isolator valve controls the flow of pumped gas through the secondary pump.

13. A gas pumping system according to claim 12, in which the regulator and/or isolator valve is controlled by a motor (8) and by control means (9) so as to regulate pressure upstream from the secondary pump (5).

14. A molecular drag, turbomolecular, or turbo/drag hybrid pump, comprising:

an outlet stage comprising a peripheral wall and a radial outlet orifice passing through the peripheral wall;

an integrated valve that regulates a flow of gas through the pump, the valve comprising an annular coaxial member comprising a through slot that co-operates with the radial outlet orifice of the outlet stage in order to regulate the flow of gas, and wherein the annular coaxial member is rotatable so as to selectively position the through slot in axial alignment with the radial outlet orifice and out of axial alignment with the radial outlet orifice so as to regulate the flow of gas.

15. The pump according to claim 14, wherein the annular coaxial member further comprises a shutter that co-operates with the radial outlet orifice of the outlet stage in order to shut off the flow of gas when the annular coaxial member is rotated so as to position the shutter in radial alignment with the radial outlet orifice.

16. The pump according to claim 14, wherein the annular coaxial member is placed either:

inside the peripheral wall in an annular delivery space, the annular coaxial member bearing against the inside face of the radial outlet orifice; or outside and around the peripheral wall such that the annular coaxial member bears against an outside face of the radial outlet orifice.

17. The pump according to claim 14, further comprising an inlet pipe that delivers an inert gas into the annular delivery space of the outlet stage.

18. The pump according to claim 14, wherein the through slot is axially positioned in and out of alignment with the radial outlet orifice by rotating the annular coaxial member.

19. The pump according to claim 14, wherein the through slot is a through hole passing radially through the annular coaxial member.

20. The pump according to claim 14, wherein the through slot extends only partially in a circumferential direction.

* * * * *